US008939779B1

(12) United States Patent
Lindblom et al.

(10) Patent No.: US 8,939,779 B1
(45) Date of Patent: Jan. 27, 2015

(54) ELECTRO-MECHANICAL CONNECTION FOR LIGHTING

(71) Applicant: Streater LLC, Albert Lea, MN (US)

(72) Inventors: Thomas G. Lindblom, Claremont, MN (US); Peter K. Nelson, Hartland, MN (US)

(73) Assignee: Streater LLC, Albert Lea, MN (US)

( * ) Notice: Subject to any disclaimer, the term of this patent is extended or adjusted under 35 U.S.C. 154(b) by 0 days.

(21) Appl. No.: 13/947,649

(22) Filed: Jul. 22, 2013

(51) Int. Cl.
*H01R 25/00* (2006.01)
*H01R 13/62* (2006.01)

(52) U.S. Cl.
CPC ..... *H01R 13/62* (2013.01)
USPC ..... 439/121

(58) Field of Classification Search
USPC ..... 362/133, 127, 134, 147; 439/121
See application file for complete search history.

(56) References Cited

U.S. PATENT DOCUMENTS

| | | | | |
|---|---|---|---|---|
| 4,688,869 | A * | 8/1987 | Kelly | 439/209 |
| 4,996,636 | A * | 2/1991 | Lovett | 362/431 |
| 5,722,847 | A * | 3/1998 | Haag | 439/320 |
| 5,902,150 | A * | 5/1999 | Sigl et al. | 439/587 |
| 6,599,145 | B2 * | 7/2003 | Singh | 439/329 |
| 6,808,407 | B1 * | 10/2004 | Cannon | 439/314 |
| 8,616,757 | B2 * | 12/2013 | Leadford et al. | 362/649 |
| 2010/0103701 | A1 * | 4/2010 | Bartlett et al. | 362/648 |
| 2013/0337668 | A1 * | 12/2013 | Ernest et al. | 439/110 |

* cited by examiner

*Primary Examiner* — Briggitte R Hammond
(74) *Attorney, Agent, or Firm* — Nikolai & Mersereau, P.A.; Thomas J. Nikolai

(57) ABSTRACT

An electro-mechanical connection is provided for transmitting power to one or more light sources affixed to the shelves of a shelving system. The connection eliminates the need to run wires the entire distance from the light source to a source of power and enables efficient and accurate coupling of the components. This is achieved by provided a slim track strip extending the height of the shelving unit and a specially designed twist connector for tapping off wiring harnesses from the slim track at the level of individual shelves where the harness leads to shelf-mounted light sources.

16 Claims, 7 Drawing Sheets

ELECTRO-MECHANICAL CONNECTION FOR LIGHTING

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to lighting for shelving systems and, more specifically, to electrical connectors for connecting low voltage light sources to low voltage electrical slim tracks associated with such shelving systems.

II. Related Art

Various forms of lighting have been employed in retail establishments. Lighting is used on signage, to provide security, to accent and better display product features, to enhance the prominence and attractiveness of merchandise and to affect the mood of customers. The eye is drawn to brighter areas of contrasting light. Reading of packaging and labeling is easier in well lighted areas.

Many retail establishments employ overhead ambient light sources and shelving systems for holding merchandise which include a set of vertically arranged shelves which are relatively deep and opaque. This arrangement causes shadows to be cast upon items placed on the lower shelves of the set of shelves because the upper shelves block much of the light.

Various lighting and shelving systems have been employed to address this issue. However, such lighting systems often include long wires extending from each individual light source all the way back to a power source. The wires are often twist-tied to shelves and other components of the shelving system, but this is a laborious process and the result is unpleasing from an aesthetics standpoint.

SUMMARY OF THE INVENTION

The electro-mechanical connection comprises a low voltage electrical slim track, a twist lock connector and a harness. The slim track has an elongate slot defined by first and second lips, a first track conductor adjacent the first lip and extending along a first side of the slot and a second track conductor adjacent the second lip and extending along a second side of the slot.

The twist lock connector comprises a plastic connector housing having first and second ends, first and second support ribs located at the first end of the connector housing, an interior wall defining a central channel extending the entire length and open to the first and second ends, and a flange having first and second gaps. The twist lock connector further comprises a first mating member extending from the connector housing and having a first exterior shape and a first mating channel, and a second mating member extending from the connector housing and having a second exterior shape different than the first exterior shape and a second mating channel. The twist lock connector also has first and second locking tabs. The first locking tab extends across the first gap on the flange and is mounted, such as by an integrally formed living hinge, to the flange for movement between a locked position and an unlocked position. Likewise, the second locking tab extends across the second gap on the flange and is similarly mounted to the flange by a living hinge for movement between a locked position and an unlocked position. The twist lock connector further includes first and second connector contacts. Each of the first and second connector contacts has first and second legs extending perpendicular to each other. The first leg of the first connector contact is in engagement with the first support rib of the housing and the second leg of the first connector contact extends through the central channel of the housing and into the first mating channel of the first mating member. Likewise, the first leg of the second conductor contact is in engagement with the second support rib of the housing and the second leg of the second conductor contact extends through the central channel of the housing and into the second channel of the second mating member. The twist lock connector further comprises a contact plug cooperating with the interior wall defining the central channel of the housing to retain the first and second connector contacts in place.

When the locking tabs are in the unlocked position, the first legs of the first and second connector contacts are adapted to be inserted into the elongate slot of the low voltage electrical slim track and rotated to bring the first leg of the first connector contact into conductive engagement with the first track conductor and the first leg of the second connector contact into conductive engagement with the second track conductor. When the locking tabs are in the locked position the first legs of the first and second connector contacts cannot be rotated out of engagement with the track conductors. Also, the twist lock connector is held in place vertically along the track because the first legs of the connector contacts and the flange of the twist lock connector reside on opposite sides of the lips (and possibly also the track conductors) of the slim track and provide a pinching force.

The harness comprises a cable. At the one end of the cable is a first harness housing having a first end and a second end, a first port having a first interior shape corresponding to exterior shape of the first mating member of the twist lock connector and open to the first end, a second port having a second interior shape corresponding to exterior shape of the second mating member of the twist lock connector and open to the first end. The harness connector further comprises an electrical contact located in the first port of the first harness housing and coupled to a first conductor of the twist lock connector and an electrical contact located in the second port of the first harness housing and coupled to a second conductor of the twist lock connector. The harness connector is adapted to be joined to the twist lock connector by mating the first part with the first mating member and the second port with the second mating member to thereby provide a conductive engagement. A second end of the cable may be attached directly to a light source or to a second harness housing used to couple the harness to a light source such that the light source is powered from the track via the twist lock and harness. The second harness housing may be identical to the first harness housing. The design of the second harness housing may be modified to accommodate connection to any of a variety of light sources and the design of the second harness housing will, therefore, depend on the light source selected for use.

BRIEF DESCRIPTION OF THE DRAWINGS

The foregoing features, objects and advantages of the invention will become apparent to those skilled in the art from the following detailed description and with reference to the following drawings in which like numerals in the several views refer to corresponding parts.

DETAILED DESCRIPTION

Figure 1:
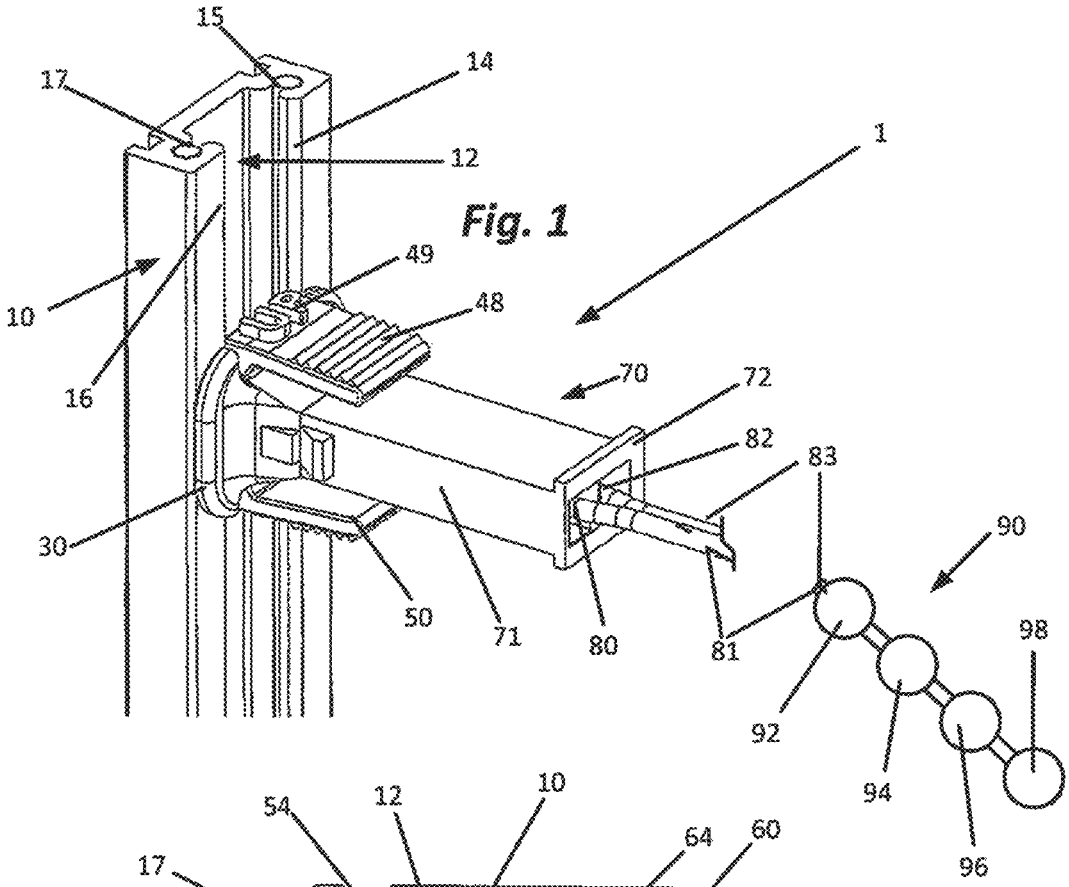
FIG. 1 is a perspective view of an electro-mechanical connection.

The description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressly described otherwise.

FIG. 1 shows a novel electro-mechanical connection comprising a low voltage electrical slim track 10, a twist lock connector 20 (FIG. 3), a harness 70 and a light source 90. The low voltage electrical slim track 10 comprises an elongated slot 12 defined by a first lip 14 and a second lip 16. Extending along the length of the elongate slot 12 adjacent the first lip 14 is a first track conductor 15. Extending along the elongate slot 12 adjacent the second lip 16 is a second track conductor 17. The lips 14 and 16 and the conductors 15 and 17 extend substantially the entire length of the elongate slot 12.

When the electro-mechanical connection 1 of the present invention is used in connection with shelving, such as retail shelving, the low voltage electrical slim track 10 can be attached to the back of the shelving so that it extends vertically from the bottom of the shelving to the top with the slot opening defined by the lips 14 and 16 facing the front of the shelving. Those skilled in the art will recognize that a power supply (not shown) will be coupled to the electrical slim track 10 for delivery of electrical power along the entire length of the first and second track conductors 15 and 17.

Figure 3:
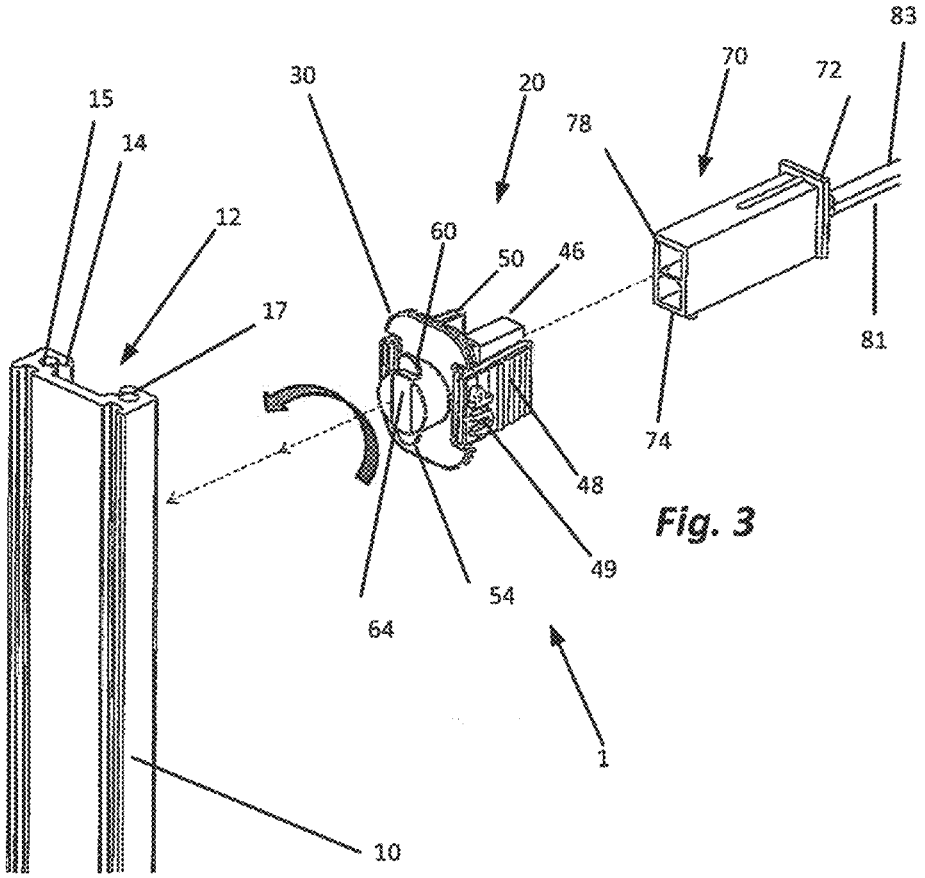
FIG. 3 is a partial exploded view of the electro-mechanical connection shown in FIG. 1.

The electro-mechanical connection 1 further includes a twist lock connector 20 (FIG. 3). The twist lock connector is designed so that it can be coupled to the track 10 at any point along the elongate slot 12 and track conductors 15 and 17. While one such twist lock connector 20 is shown in the drawings, the reader should appreciate that multiple twist lock connectors 20 can be attached to the track at various desired locations along the track. Each twist lock connector 20 includes a plastic connector housing 22 (FIG. 4) having a first end 24 and a second end 26. The connector housing surrounds a central channel, defined by an interior wall 28, which extends between, and is open to, the first end 24 and second end 26 of the housing.

The plastic connector housing 22 also includes a flange 30 adjacent to the first end 24 of the housing 22. The flange includes a first inset or gap 32 and a second inset or gap 34. Projecting forward of the flange 30 is a cylindrical member 35 having a first support rib 36 and a second support rib 38 separated by a first rib divider 40 and a second rib divider 42.

Extending from the second end 26 of connector housing 22 is a first mating member 44 having a first mating channel 45 and a second mating member 46 having a second mating channel 47. The first and second mating members 44 and 46 are shown as having two different exterior, i.e., cross-sections. The first mating channel 45 and second mating channel 47 comprise generally rectangular bores that extend the entire length of the associated mating member and are in open communication with the central channel defined by interior wall 28 of the connector housing 22.

Pivotally connected to the connector housing 22 of twist lock connector 20, such as by integrally formed living hinges, is a pair of locking tabs 48 and 50. First locking tab 48 extends across and is pivotally secured within the first gap 32 for pivotal movement between the first locked position and a second unlocked position. Likewise, the second locking tab 50 is positioned within the second gap 34 for similar pivotal movement between a first locked position and a second unlocked position. Pins, axles, or ears can be used instead of integrally formed living hinges to pivotally secure the locking tabs 48 and 50 within the respective gaps 32 and 34. As shown in the drawings, a raised orientation note 49 is formed onto the first locking tab 48 and signifies the "up" position of the connector when the connector is joined to the electrical slim track 10.

Figure 4:
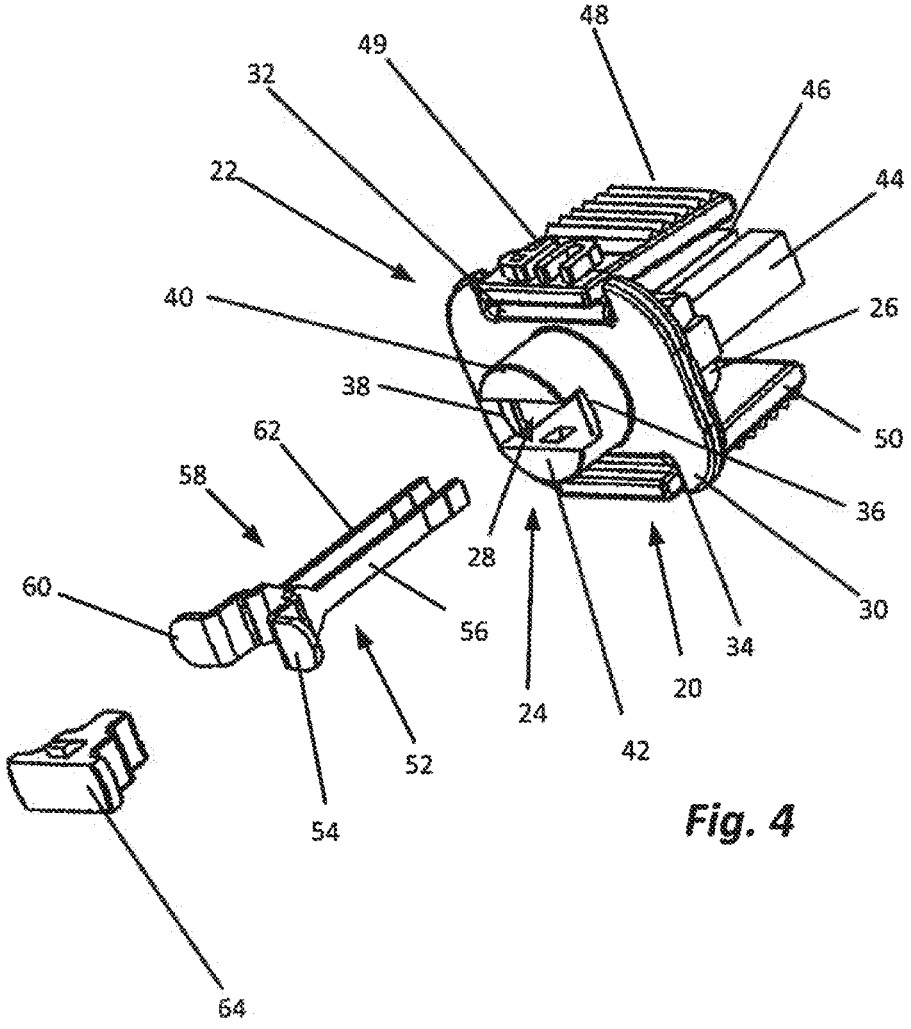
FIG. 4 is an exploded view of the twist lock connector of the electro-mechanical connection shown in FIG. 1.
Figure 5:
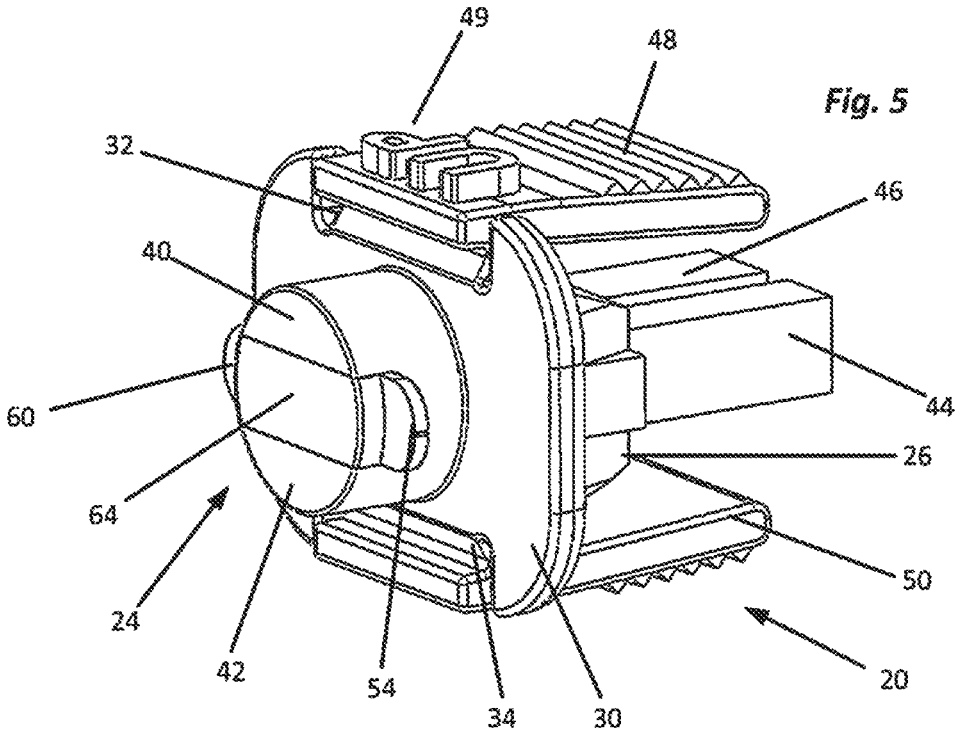
FIG. 5 is a perspective view of the twist lock connector of the electro-mechanical connection shown in FIG. 1.
Figure 6:
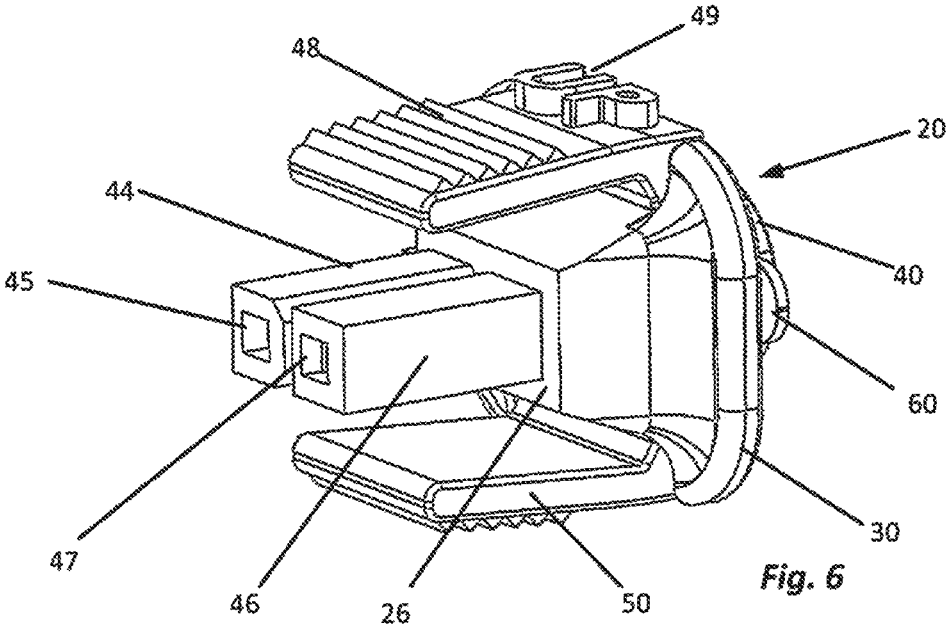
FIG. 6 is a second perspective view of the twist lye lock connector of the electro-mechanical connection shown in FIG. 1.
Figure 7:
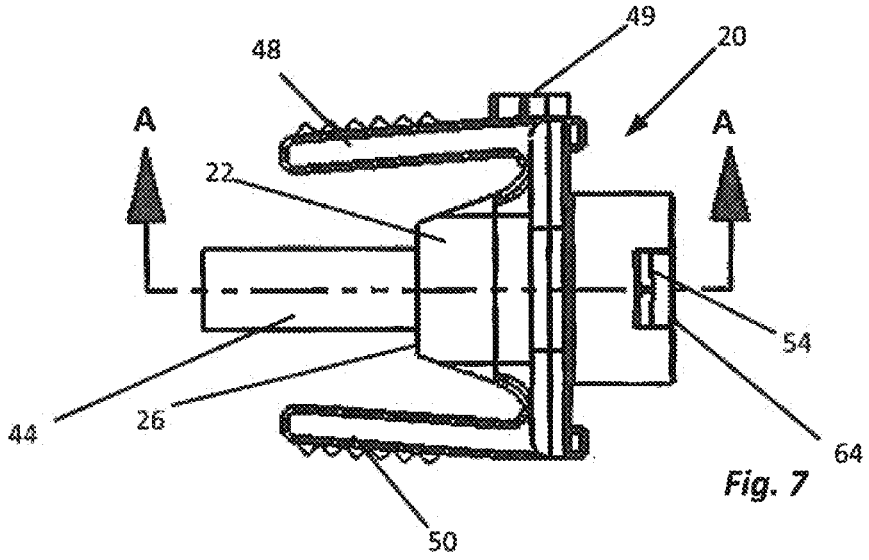
FIG. 7 is a side view of the twist lock connector.
Figure 7A:
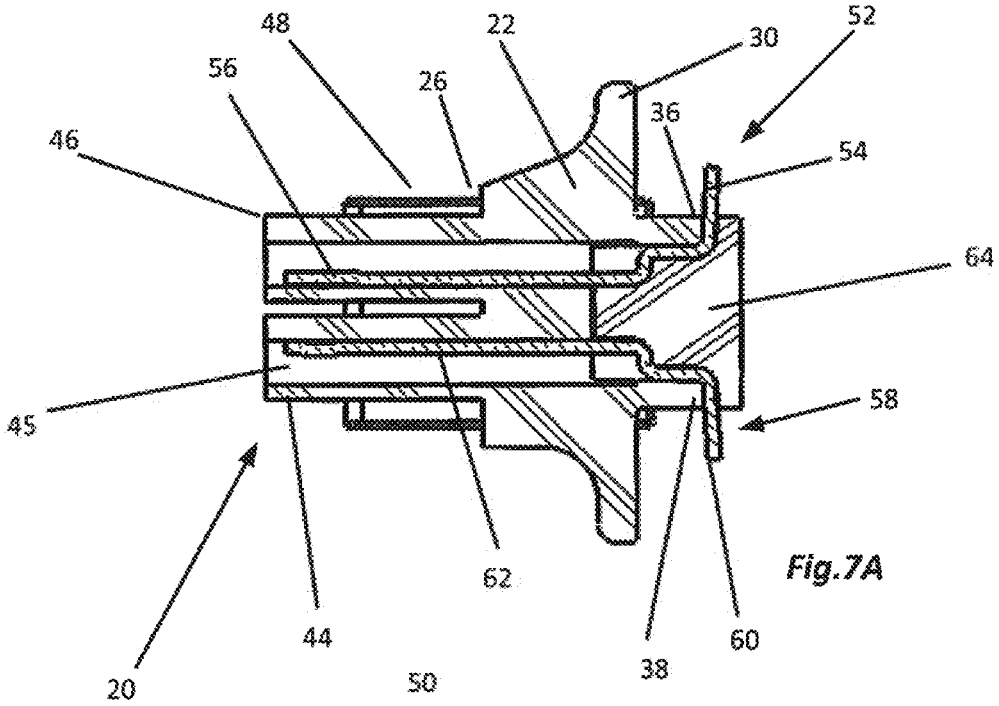
FIG. 7A is a cross-section through line A-A in FIG. 7.

The twist lock connector 20 also includes a first connector contact 52 (FIG. 4). Connector contact 52 has a first leg 54 and a second leg 56. The two legs extend generally perpendicular to each other. The first leg 54 of the first connector contact 52 extends over and engages the first support rib 36 while the second leg 56 of the first connector contact extends through the central channel of the housing and into the first mating channel 45 of the first mating member 44. Also shown is a second connector contact 58 which also has a first leg 60 and a second leg 62. The first leg 60 of the second connector contact 58 engages the second support rib 38 while the second leg 62 extends through the central channel 28 of the housing and into the second mating channel 47 of the second mating member 46. A contact plug 64 cooperates with a first rib divider 40 and a second rib divider 42 and also with the walls defining the first mating channel 45 and second mating channel 46 to provide appropriate spacing between the first and second connector contacts 52 and 58 to prevent a short circuit and to retain the connector contacts 52 and 58 in place, all as best seen in FIG. 7A.

Figure 2:
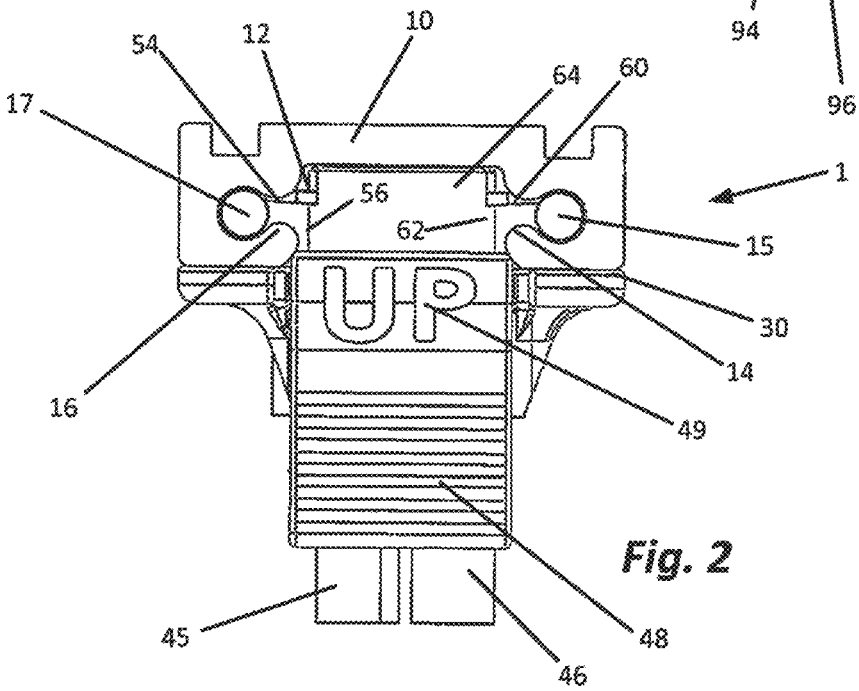
FIG. 2 is a top view of a portion of the electro-mechanical connection shown in FIG. 1.

As illustrated in FIGS. 1-3, the twist lock connector is adapted to be joined to the electrical slim track 10. To join the twist lock connector 20 to the electrical slim track 10, the twist lock connector 20 is placed in the position shown in FIG. 3 and the two locking tabs 48 and 50 are squeezed together toward the first and second mating members 44 and 46. The twist lock connector 20 is then advanced toward the track until the flange 30 engages the lips 14 and 16 of the track. The twist lock connector 20 is then rotated about 90 degrees as illustrated in FIG. 3 into the position shown in FIGS. 1 and 2. This causes the ends of the first legs 54 and 60 of the connector contacts 52 and 58 to engage and form an electrical connection with the track conductors 15 and 17.

More specifically, the first legs 54 and 60 of connector contacts 52 and 58 reside on the inside of lips 14 and 16 of the track in electrical contact with the respective track conductors while the flange 30 resides on the outside of lips 14 and 16. The tolerances are such that the flange 30 and first legs 54 and 60 provide a pinching force which retains the twist lock connector at the desired vertical location along the track 10. Releasing the locking tabs 48 and 50 causes them to return to the locked position preventing rotation (and inadvertent release) of the twist lock connector 20 relative to the electrical slim track 10 until the locking tabs 48 and 50 are again squeezed toward each other. To prevent the twist lock connector 20 from being rotated in the wrong direction and thereby reduce the possibility of crossed electrical connections, indicia in the form of raised orientation 49 are provided.

Figure 8:
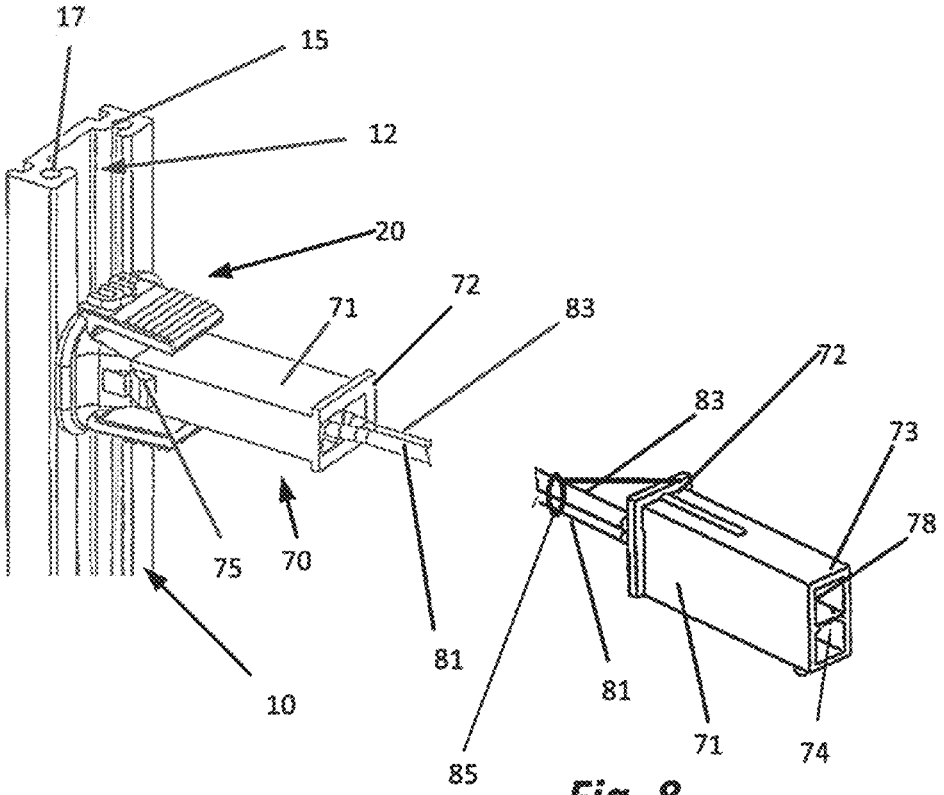
FIG. 8 is a perspective view showing a harness conductor comprising two identical harness housings.

As shown in FIGS. 1 and 3, the electro-mechanical connection 1 also includes a harness 70. The harness 70 includes a cable containing at least two wires 81 and 83. The wires 81 and 83 of the harness 70 may be coupled at one and to a first harness housing 71 and at the other end to a light source 90 (such as by soldering the ends of the wires 81 and 83 to the light source 90) as suggested by FIG. 1. Alternatively, a second harness housing 71 may be employed at the opposite ends of the wires 81 and 83 as shown in FIG. 8 such that two harness housings 71 are provided. In this case, the second harness housing is used to connect the harness 70 to the light source 90.

The first harness housing 71 has a first end 72 coupled to the cable and a second end 73. The first harness housing 71 has, at the second end 73, an opening to a first port 74 and an opening to a second port 78. The ports 74 and 78 of the first harness housings 71 are sized to receive the first and second mating members 44 and 46 of the twist lock connector 20. To ensure the electrical connections are properly made, the interior wall defining the first port 74 has the same shape as the exterior wall of the first mating member 44 and the first port 74 is sized to receive the first mating member 44. Likewise, the interior wall defining the second port 78 of the harness housing 71 has a shape matching the exterior wall of the second mating member 46. The second port 78 is designed to receive the second mating member 46. The risk of an improper cross-connection between the twist lock connector 20 and first harness housing 71 is eliminated because the shapes of the two ports 74 and 78 differ and because the shapes of the mating members 44 and 46 also differ.

To provide electrical connectivity, the first harness housing 71 contains a third electrical, contact 80 (FIG. 1) located within the first port 74 and a fourth electrical contact 82 located within the second port 78. As such, when the first harness housing 71 is mated with the twist lock connector 20, the third electrical contact 80 engages the first connector contact 52 and the fourth electrical contact 82 engages the second connector contact 56.

As best shown in FIG. 1, wire 81 extends from the third electrical contact 80 of harness 70 and a wire 83 extends from the fourth electrical contact 82 of the harness 70. These wires 81 and 83 electrically couple a light source 90 to the harness 70. The light source 90 can be of any standard type including one or more incandescent bulbs, one or more fluorescent tubes, but in low voltage applications LEDs have proven to be highly advantageous. In FIG. 1, the light source is shown as including four LEDs 92, 94, 96 and 98. These LEDs may be single color LEDs or multi-colored LEDs. Likewise, when single colored LEDs are used, the individual LEDs 92, 94, 96 and 98 may be of different colors.

Rather than making the direct connection between the wires 81 and 83 and the light source 90 shown in FIG. 1, certain benefits may result from proving a second harness housing 71 at the second ends of the wires 81 and 83 as shown in FIG. 8. The two harness housings 71 may have identical configurations. Alternatively, one of the harness housings 71 may be adapted for use with a particular style of twist lock connector 20 and the other harness housing 71 adapted for use with a particular style of light fixture 90. Further, raised indicia, such as 75, may be provided on the harness housings 71 to help a user align and attach the harness housings 71 to light source 90 and twist lock connector 20.

Based upon the foregoing description, one of ordinary skill in the art will appreciate that the electro-mechanical connection 1 provides a simple, clean, neat, tidy, useful and attractive mechanism for lighting retail shelving or the like. More importantly, the electrical connection described above eliminates the need for wires to dangle or to be bundled or to run all the way from a light source to a power supply. Instead, a single power supply powers the track 10. Likewise, the electro-mechanical connection 1 permits one or more light sources 90 to be attached to each shelf of a shelving unit, allowing the height of the individual shelves of the shelving unit to be adjusted and for a short, direct connection to be made between the light source and the track at whatever height the individual shelves are placed.

While the harness housings 71 frictionally engage the conductors leading to the light sources as well as the twist lock connectors 20 to which they are attached to ensure a stable electrical connection, there is no mechanism firmly locking the harness housings 71 in place. Thus, should a user remove a shelf without first disconnecting the harness connector 70 from the light source or twist lock connector 20, the harness connector 70 will automatically disconnect from the twist lock connector 20 and/or light source when the shelf is removed without damaging any of the components. To add strength and durability, a strain relief 85 may be coupled between the cable and the harness housings 71 of the harness connector 70 as also illustrated in FIG. 8.

Figure 9:
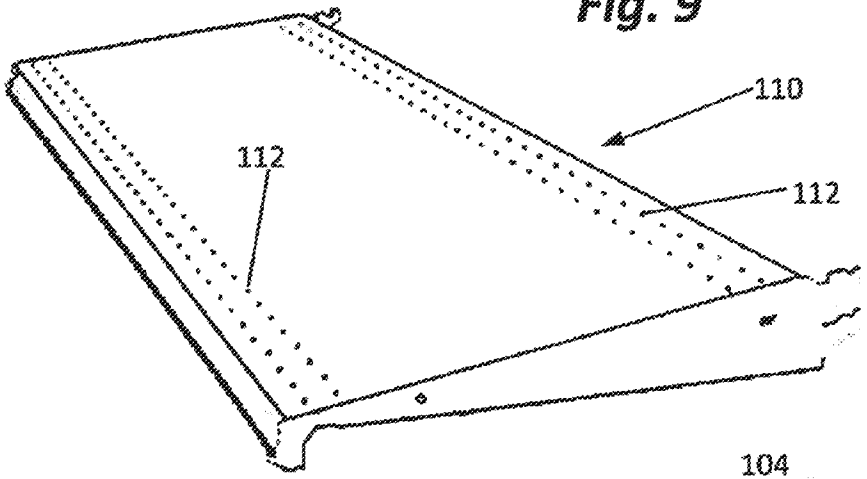
FIG. 9 is a perspective view of a gondola-type shelf.

The components of the electro-mechanical connection described above are well-suited for lighting a gondola-type shelving system. The track 10 can be mounted to the back and extend vertically. Twist lock connectors 20 can be positioned in the track 10 at approximately the same height as the shelves. See, for example, shelf 110 in FIG. 9, and the light source 90 can be fastened to the bottom of the shelf at its front edge. The harness 70 can then be attached to the twist lock connector 20 and light source 90 with the wires 81 and 83 being out of sight and running from the front to the back of the shelf 110 beneath the shelf 110.

Figure 10:
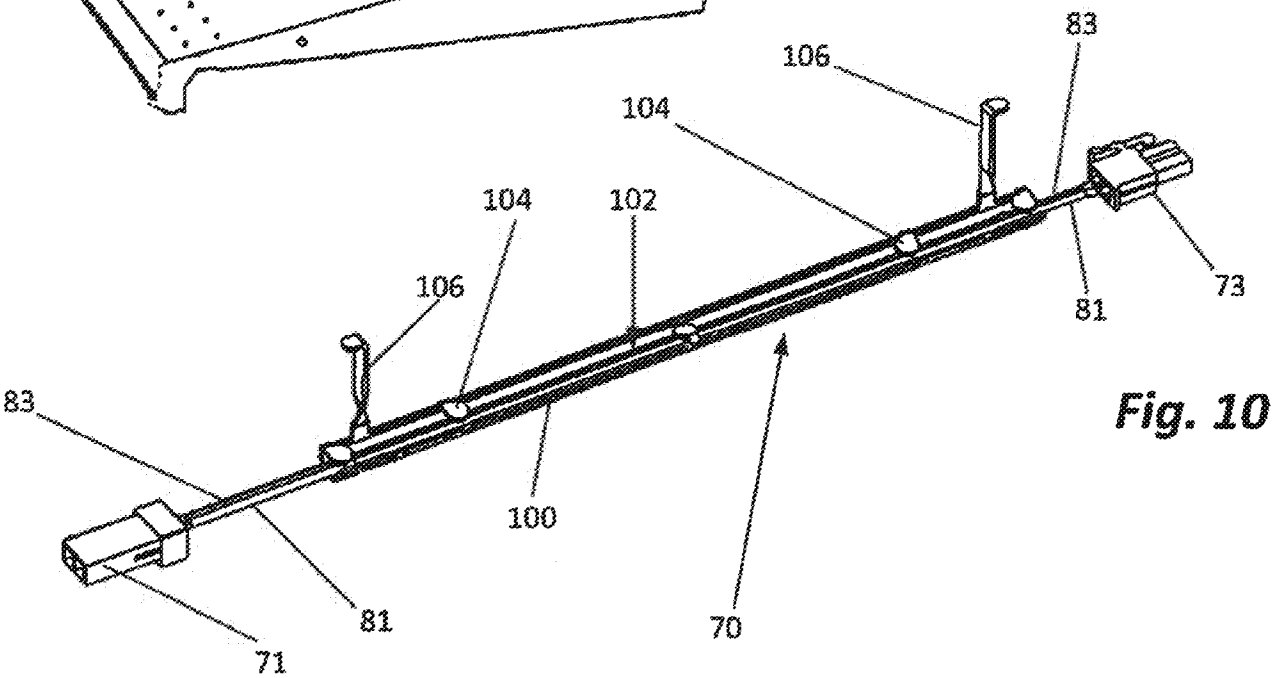
FIG. 10 is a perspective view of a harness suited for use with gondola-type shelving.

FIG. 10 shows a modification to the harness 70 which provides for even a neater and cleaner installation. As shown in FIG. 10, the harness 70 has a pair of harness housings 71 and 73. Harness housings 71 form a connection with a twist lock connector 20 and the other harness housing 73 forms a connection with the light source 90 as described above. A cable, comprising wires 81 and 83, extends between and electrically couples the two harness housings 71 and 73. The harness 70 further includes a wire tray 100. The wire tray 100 has a U-shape cross section and is elongate extending substantially the length of the wires 81 and 83. The wire tray 100 thus includes a channel 102 extending its entire length in which the wires 81 and 83 reside with only a small portion of the wires extending past the two ends of the wire tray 100. The wire tray 100 also has a plurality of retainers 104 which can be bent over the top of the channel 102 after the wires 81 and 83 have been placed in the channel 102 to secure the wires 81 and 83 in the channel 102. The wire tray 100 also includes at least one coupling member 106 to secure the wire tray 100 to an undersurface of a shelf such as shelf 110.

The style of coupling member 106 will vary depending upon the nature of the shelf. The coupling member 106 may be in the form of a magnet, screw, adhesive, clip, hook or the like. FIG. 10 shows two coupling members 106 which are suited for use with a gondola shelf 110 of the type shown in FIG. 9. It includes rows of holes 112 extending along the front and back. As shown in FIG. 10, the coupling members 106 are upstanding hooks integrally formed with and extending upwardly from the wire tray 100. One of the hooks 106 mates with a hole 112 near the front of the shelf 110 while the other hook 106 mates with a hole 112 near the back of the shelf 110 to secure the wire tray and harness 70 to the shelf 110. The length of the hooks 106 will depend on the height of any shelf framing members (not shown) on the underside of the shelf 110 which must be crossed by the wire track 100.

When the wire harness 70 including the wire tray 100 of FIG. 10 is employed, prior to mounting of the shelf 110 to a shelving system, the light source 90 may be mounted to the underside and proximate the front of shelf 110, the wire tray may also be mounted to the shelf 110 by coupling the hooks 106 of wire tray 100 with holes 112 of the shelf, and the connection between the light source 90 and harness housing 73 of the harness 70 may be made. Likewise, the twist lock connector 20 may be coupled to the track 10 before the shelf 110 is installed so that after installation of the shelf 110, the only connection remaining to be made is between the other harness housing 71 and the twist lock connector 20. This makes installation extremely easy. The installer is not required to make all of the electrical connections and route wires after installation of the shelves which can be awkward and difficult. Further, because there are no locks used to couple the twist lock connector 20 and harness housing 71 together, the connection between the twist lock connector 20 and harness housing 71 simply pulls apart when a shelf 110 is removed from the shelving system.

From the foregoing, it will also be appreciated that although the specific examples have been described herein for purposes of illustration, various modifications may be made without deviating from the spirit or scope of this disclosure. It is therefore intended that the foregoing detailed description be regarded as illustrative rather than limiting and that the following claims, including all equivalents, are intended to define the invention.

What is claimed is:

1. An electro-mechanical connection comprising:

a. a low voltage electrical slim track having an elongate slot defined by first and second lips, a first track conductor adjacent the first lip and extending along a first side of the slot and a second track conductor adjacent the second lip and extending along a second side of the slot;

b. a twist lock connector comprising (i) a plastic connector housing having first and second ends, first and second support ribs located at the first end of the housing, an interior wall defining a central channel extending between and open to the first and second ends, and a flange having first and second gaps, (ii) a first mating member extending from the second end of the connector housing and having a first exterior shape and a first mating channel, (iii) a second mating member extending from the second end of the housing and having a second exterior shape different from the first exterior shape and a second mating channel, (iv) a first and second locking tabs, the first locking tab extending across the first gap and mounted to the flange for movement between a locked position and an unlocked position, and the second locking tab extending across the second gap and mounted to the flange for movement between a locked position and an unlocked positions; and (v) first and second connector contacts, each of the first and second connector contacts having first and second legs, the first leg of the first connector contact in engagement with the first support rib of the connector housing and the second leg of the first connector contact extending through the central channel of the housing and into the first mating channel of the first mating member, and the first leg of the second conductor contact in engagement with the second support rib of the connector housing and the second leg of the second conductor contact extending through the central channel of the housing and into the second channel of the second mating member, and (vi) a contact plug retaining the first and second connector contacts;

wherein when the locking tabs are in the unlocked position, the first legs of the first and second connector contacts are adapted to be inserted into the elongate slot of the low voltage electrical slim track and rotated to bring the first leg of the first connector contact into conductive engagement with the first track conductor and the first leg of the second connector contact into conductive engagement with the second track conductor; and wherein when the locking tabs are in the locked position the first legs of the first and second connector contacts cannot be rotated out of engagement with the track conductors.

2. The electro-mechanical connection of claim 1 further comprising a harness comprising a first harness housing having a first end and a second end, a first port having a first interior shape corresponding to the exterior shape of the first mating member and open to the first end, a second port having a second interior shape corresponding to the exterior shape of the second mating member and open to the first end, a third electrical contact located in the first port of the harness housing adapted to be coupled to a first conductor, and a fourth electrical contact located in the second port of the harness housing and adapted to be coupled to a second conductor; and wherein the harness connector is adapted to be joined to the twist lock connector by mating the first port of the harness housing with the first mating member of the twist lock connector and the second port of the harness housing with the second mating member of the twist lock connector to thereby provide a conductive engagement between the first and third electrical contacts and between the second and fourth electrical contacts.

3. The electro-mechanical connection of claim 2 further including a light source electrically coupled to the third and fourth electrical contacts by first and second wires.

4. The electro-mechanical connection of claim 1 wherein the first locking tab includes an orientation marking.

5. The electro-mechanical connection of claim 2 wherein the harness has a second harness housing adapted to couple the harness to a light source.

6. The electro-mechanical connection of claim 5 wherein the first harness housing and second harness housing have the same configuration.

7. The electro-mechanical connection of claim 1 wherein the first and second locking tabs are joined to the flange by living hinges.

8. The electro-mechanical connection of claim 2 wherein the harness further comprises a strain relief.

9. For lighting a shelving system, an electro-mechanical connection comprising:

a. a low voltage electrical slim track having an elongate slot defined by first and second parallel, spaced-apart lips, a first track conductor adjacent the first lip and extending along a first side of the slot and a second track conductor adjacent the second lip and extending along a second side of the slot;

b. a twist lock connector comprising (i) a plastic connector housing having first and second ends, first and second support ribs located at the first end of the connector housing, an interior wall defining a central channel extending between and open to the first and second ends, and a flange having first and second gaps, (ii) a first mating member extending from the second end of the connector housing and having a first exterior shape and a first mating channel, (iii) a second mating member extending from the second end of the connector housing and having a second exterior shape different from the first exterior shape and a second mating channel, (iv) first and second locking tabs, the first locking tab extending across the first gap and mounted to the flange for movement between a locked position and an unlocked position, and the second locking tab extending across the second gap and mounted to the flange for movement between a locked position and an unlocked positions; and (v) first and second connector contacts, each of the first and second connector contacts having first and second legs, the first leg of the first connector contact in engagement with the first support rib of the connector housing and the second leg of the first connector contact extending through the central channel of the connector housing and into the first mating channel of the first mating member, and the first leg of the second conductor contact in engagement with the second support rib of the connector housing and the second leg of the second conductor contact extending through the central channel of the connector housing and into the second channel of the second mating member, and (vi) and a contact plug retaining the first and second connector contacts; wherein when the locking tabs are in the unlocked position, the first legs of the first and second connector contacts are adapted to be inserted into the elongate slot of the low voltage electrical slim track and rotated to bring the first leg of the first connector contact into conductive engagement with the first track conductor and the first leg of the second connector contact into conductive engagement with the second track conductor; and wherein when the locking tabs are in the locked position the first legs of the first and second connector contacts cannot be rotated out of engagement with the track conductors;

c. a shelf mounted light source; and d. a harness comprising a cable having first and second wires, a first harness housing adapted to mate with the first and second mating members of the twist lock connector to form a first electrical connection between the first wire of the cable and the first connector contact of the twist lock connector and a second electrical connection between the second wire of the cable and the second connector contact of the twist lock connector, and a second harness housing adapted to be joined to the light source such that the light source is energized via the first and second track conductors, twist lock connector and harness.

10. The electro-mechanical connection of claim 9 wherein the light source comprises a plurality of light emitting diodes.

11. The electro-mechanical connection of claim 9 wherein the harness comprises a strain relief.

12. The electro-mechanical connector of claim 9 wherein the harness comprises a wire tray comprising a channel for containing the harness and means for connecting the wire tray to the underside of a shelf.

13. The electro-mechanical connector of claim 12 wherein the means for connecting the wire tray to the underside of the shelf comprise a pair of hooks.

14. An electro-mechanical connection comprising:

a. a shelf having an underside;

b. a low voltage slim track;

c. a twist lock connector adapted to be operatively coupled to the slim track;

d. a light source mounted to the underside of the shelf; and e. a harness comprising (i) an elongate electrical cable of a predetermined length having a first and second end, (ii) a first connector coupled to the first end of the cable adapted to operatively couple the cable to a light source, (iii) a second connector coupled to the second end of the cable adapted to operatively couple the cable to the slim track via the twist lock connector, (iv) a wire tray comprising an elongate member having a U-shaped channel adapted to support the cable along most of the predefined length of the cable and means for securing the wire tray to the underside of the shelf.

15. The electro-mechanical connection of claim 14 wherein the wire tray includes at least one retainer for confining the cable within the wire tray.

16. The electro-mechanical connection of claim 14 wherein the shelf has a first hole and a second hole and the means for securing the wire tray to the underside of the shelf includes a first hook mated to the first hole and a second hook mated to the second hole.

* * * * *